US005903815A

United States Patent [19]

Scott

[11] Patent Number: 5,903,815

[45] Date of Patent: May 11, 1999

[54] COMPOSITE POWDERED METAL COMPONENT

[75] Inventor: Norman William Scott, St. Thomas, Canada

[73] Assignee: ICM/Krebsoge, Livonia, Mich.

[21] Appl. No.: 07/834,379

[22] Filed: Feb. 12, 1992

[51] Int. Cl.[6] ..... B22F 3/12; B22F 7/02; C22C 33/02

[52] U.S. Cl. ..... 428/564; 428/548; 419/7; 419/11; 419/38

[58] Field of Search ..... 419/2, 5, 6, 7, 419/38, 11, 49, 51; 428/547, 548, 550, 564

[56] References Cited

U.S. PATENT DOCUMENTS

| | | | |
|---|---|---|---|
| 3,373,003 | 3/1968 | Schreiner | 29/182.2 |
| 4,214,906 | 7/1980 | Langer et al. | 75/208 R |
| 4,329,175 | 5/1982 | Turner | 75/208 R |
| 4,472,350 | 9/1984 | Urano | 419/6 |
| 4,503,009 | 3/1985 | Asaka | 419/6 |
| 5,043,123 | 8/1991 | Gormanns et al. | 264/113 |
| 5,056,209 | 10/1991 | Ohashi et al. | 29/517 |
| 5,069,866 | 12/1991 | Ekbom | 419/6 |
| 5,110,349 | 5/1992 | Westergren et al. | 75/233 |

OTHER PUBLICATIONS

Klar et al., Metals Handbook Ninth Edition, vol. 7, *Powder Metallurgy*, American Soc. for Metals, pp. 308, 309; 1984.

McGannon, "The Making, Shaping, and Treating of Steel", United States Steel, 8th ed. 1964, pp. 1069–1073, 1111–1116.

Hirschhorn, "Intro to Powder Metallurgy," American Powder Metallurgy Institute, 1969, pp. 96–99.

*Primary Examiner*—Daniel J. Jenkins

*Attorney, Agent, or Firm*—Gifford, Krass, Groh, Sprinkle, Anderson & Citkowski,P.C.

[57] ABSTRACT

A product and method are disclosed for constructing a powdered metal component from two or more discreet powdered metals in which one or more of the powdered metals is weldable following compaction while the other powdered metal is not A die having two die parts which together define a die cavity therebetween corresponding in shape to the desired metal component is first partially filled with one of the powdered metals and the remainder of the die cavity is then filled with the other powdered metal. The die parts are then compressed together to form the pressed component which, after removal from the die, is sintered. The weldable powdered metal is either powdered iron or powdered steel having a carbon content less than about 0.6% by weight carbon. Conversely, the other powdered metal is powdered steel or iron or alloyed, or mixtures thereof, having a carbon content typically greater than 0.6% by weight for enhanced hardness of the part. Alternatively, a powdered metal component is disclosed having areas of different densities.

12 Claims, 3 Drawing Sheets

COMPOSITE POWDERED METAL COMPONENT

BACKGROUND OF THE INVENTION

I. Field of the Invention

The present invention relates to a method for constructing a composite powdered metal component.

II. Description of the Prior Art

In constructing components from powdered metals, a die having both upper and lower die halves is typically used to first press the component. The die halves are movable with respect to each other and form a cavity therebetween which corresponds in shape to the shape of the desired finished component.

In order to construct the powdered metal component, with the die halves separated from each other, the die cavity is filled with the powdered metal. Thereafter, the upper die half is positioned over the die cavity and the die halves are compressed together under high pressure. The compaction of the powders within the die cavity causes the metal powders to adhere to each other so that the compacted component maintains its shape upon removal from the die.

The compacted component is then sintered, hot pressed or hot forged to densify the part. Sintering is carried out at or near the liquids temperature and bonds the particles together while hot pressing or hot forging can be carried out at lower temperatures and densities the part at or near the liquids temperature of the metal powders. In doing so, the metal powder bonds together to form a metal component.

Many of these previously known powdered metal components are formed from powdered steel powdered iron or alloys of powdered steel and powdered iron. In order to increase the strength and hardness of such parts, one prior practice has been to add carbon to the powdered metal typically in the range of 0.3–1.0% by weight, which significantly increases the hardness and strength of the finished component.

One disadvantage of adding carbon to the powdered metal, however, is that the finished component cannot he welded consistently due to the relatively high carbon content. In many applications, however, it is desirable that the component exhibit the high strength of carbon steel and still maintain the capability of welding the component in its final installation.

For example, in a gear having a hub and an annular gear rings it is highly desirable that the inside diameter of the hub enjoy a high strength and rigidity of high carbon steel while other portions of the gear remain weldable In order to accomplish this, it has been the previously known practice to carborize the inside diameter of the gear hub by axially stacking a number of hubs and then flowing carbonized gas through the interior of the stacked hubs.

While this previously known practice of hardening the interior of the gear hub by forming a carborizing gas through the hub has proven effective, it is time consuming and relatively expensive to perform. Furthermore, this previously known method is effective only for increasing the carbon content along the interior of the gear hub. Conversely, this previously known method cannot be used for hardening other portions of the gear, for example, the axial end of a hub.

In still other applications, it is necessary that the powdered metal component have some porosity, and thus a lower density, in order for the part to accept certain coatings or treatments. Such increased porosity, however, usually weakens the overall part.

SUMMARY OF THE PRESENT INVENTION

The present invention provides a product and method for constructing a composite powdered metal component which overcomes all of the above mentioned disadvantages of the previously known practices.

In brief, the method of the present invention utilizes a die having two die halves. The die halves are movable with respect to each other and define a die cavity between them which corresponds to the shape of the desired component.

A first portion of the die cavity is filled with a first weldable powdered metals. This powdered metal typically comprises powdered steel, powdered iron or alloys thereof having a carbon content of less than 0.6%. Furthermore, the portion of the die cavity which is filled with the first weldable powdered metal corresponds to the portion of the final component on which the capability of performing a weld is desired.

The remainder of the die cavity is filled with a second powdered metal which, after compaction, cannot be welded. Such a powdered metal typically comprises powdered steel, powdered iron or alloys thereof having a carbon content in excess of 0.6%. Such high carbon steel exhibits much greater toughness and hardness than lower carbon steels.

After the die cavity is filled, the die halves are compressed together thus compacting the powdered metal in the die cavity.

Following compaction of the component, the component is removed from the die and sintered in an appropriate furnace. The sintering operation bonds the powdered metal particles together in the well known fashion to form the completed component. Some machining of the sintered component, however, may be required.

The component constructed according to the present invention thus comprises two discreet regions. The first region consists of the relatively low carbon content steel which is weldable following completion of the sintering operation. Conversely, the remainder of the component forms the second region consisting of relatively high carbon powdered metal which, while not weldable, enjoys enhanced strength and toughness characteristics. Three or more regions on the component, each filled with a different powdered metal, are also possible using the method of the present invention.

In an alternate embodiment of the present invention, the powdered metal component includes at least two distinct regions which may be of the same material, but have different densities and thus different porosities. In such a component, the low density region may be desirable to accept certain coatings or treatments while the higher density region is provided where high strength and hardness are desired.

BRIEF DESCRIPTION OF THE DRAWINGS

A better understanding of the present invention will be had upon reference to the following detailed description when read in conjunction with the accompanying drawing. Wherein like reference characters refer to like parts throughout the several views, and in which.

DETAILED DESCRIPTION OF PREFERRED EMBODIMENTS OF THE PRESENT INVENTION

Figure 4:
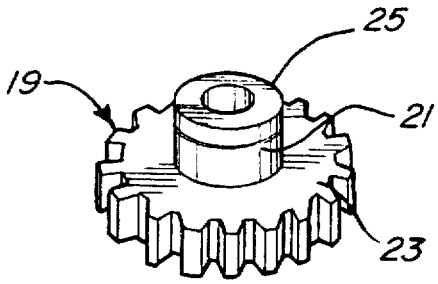
FIG. 4 is an elevational view of the finished component made in accordance with the method of FIGS. 1–3.

With reference first to FIG. 4, a component 19 constructed in accordance with the method of the present invention is thereshown. For illustrative purposes, the component 19 comprises a gear having a cylindrical hub 21 and an annular gear ring 23. The axial end 25 of the hub 21 is weldable while the remainder of the component 19 is not weldable.

With reference now to FIG. 19 a die 10 having a lower die half 12 and an upper die half 14 is thereshown. The die halves 12 and 14 are movable with respect to each other in the direction of arrow 16 and, between them, form a die cavity 18.

The die cavity 18 corresponds in shape to the shape of the final desired component 19 (FIG. 4) As such, the die cavity 18 includes a cylindrical portion 20 corresponding to the hub 21 in the lower die half 18 and an outwardly extending annular portion 22 corresponding to the gear ring 23.

Figure 2:
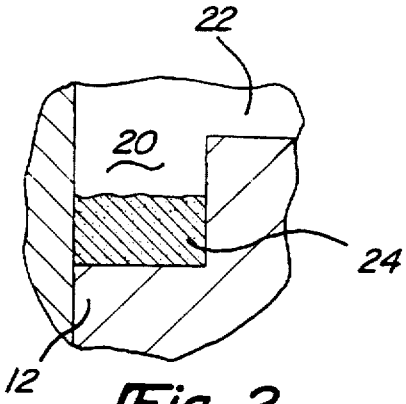
FIG. 2 is a fragmentary view illustrating one step of the method of the present invention.

With reference now to FIG. 2, in order to form the weldable axial end 25 of the hub 21, a weldable powdered metal is first filled in the lower end of the cylindrical portion of the die half 12. This portion of the completed component 19 will thus correspond to the axial end 25 of the gear hub 21. Typically, this powdered metal 24 comprises powdered steel, powdered iron or alloys thereof having a carbon content of less than 0.3% carbon by weight, although it can be up to 0.6% c.

Figure 3:
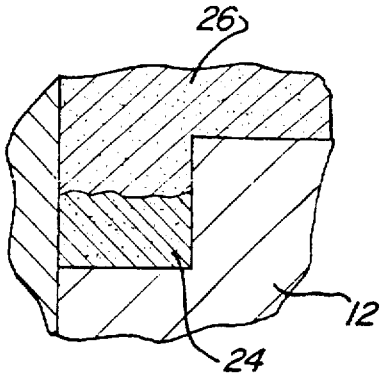
FIG. 3 is a fragmentary view similar to FIG. 2 but illustrating a further step of the method of the present invention.

With reference now to FIG. 3, after the first powdered metal 24 has been filled in the lower end of the die cavity 18, the remainder of the die cavity is filled with a second powdered metal 26. This second powdered metal 26 comprises a non-weldable powdered metal, such as powdered steel, powdered iron or alloys thereof having a carbon content of greater than 0.6% carbon by weight and preferably in the range of 0.6–09% carbon by weight. Such high carbon steel or iron enjoys increased strength and toughness over lower carbon steel or iron but such high carbon steel or iron cannot be welded following completion of the manufacture of the gear.

Figure 1:
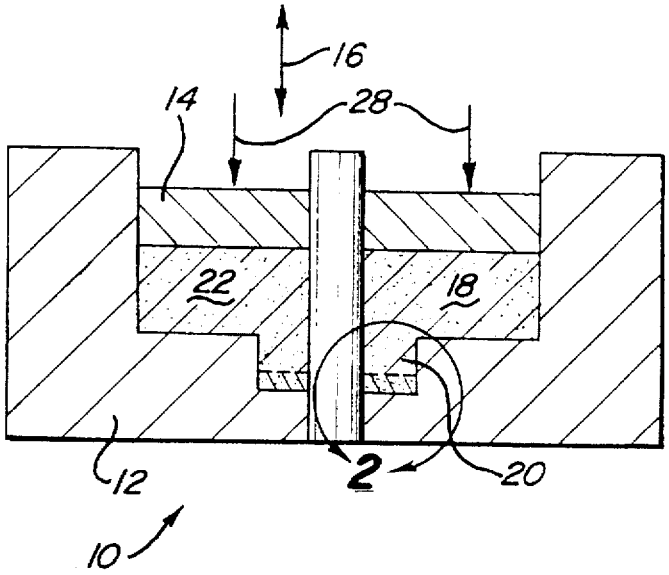
FIG. 1 is a crossectional view illustrating the method of the present invention.

With reference again to FIG. 1, after the die cavity 18 is filled with the powdered metals 24 and 26, the upper die half 14 is positioned on top of the lower die half 12 so that the powdered metals 24 and 26 are entrapped between the die halves 12 and 14 in the die cavity 18. Thereafter, a pressure is applied as indicated by arrows 28 to compact the powders together. Such pressure is typically applied in the range of 35–40 tons per square inch of die cavity surface.

The high pressure utilized to compact the powdered metals together will cause the powdered metal particles to adhere to each other so that the resulting component corresponding in shape to the die cavity 18 can be removed from the die cavity 18 as a single unit. This single unit, however, will have two discrete regions of powdered metal, namely the low carbon steel region at the axial end 25 of the hub 21 and the relatively high carbon steel throughout the remainder of the gear 19.

After removal of the component from the die cavity, the component is sintered at a temperature just less than liquids, i.e. between 1600° F. and 2500° F. The sintering operation, as is well known, bonds the metal powder together to form the final part.

As shown in FIG. 4, the component or gear 19 formed according to the present invention includes a relatively low carbon steel at the axial end 25 of its hub 21. This low carbon end 25 can thus be welded to other components in the final installation of the gear 19. Conversely, the remainder of the gear 19 comprises a high carbon steel which, although it cannot be welded, enjoys greater toughness and hardness than the low carbon steel.

Figure 5:
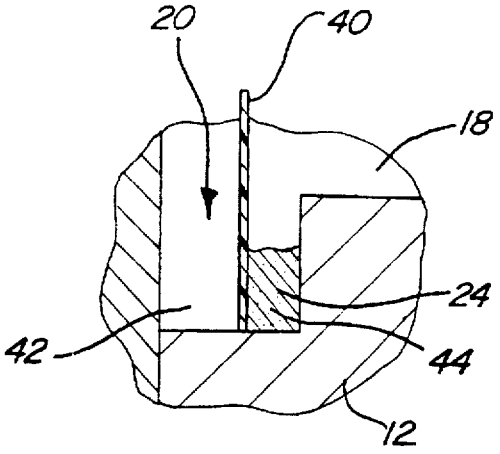
FIG. 5 is a fragmentary view similar to FIG. 2 but illustrating a modification thereof.
Figure 8:
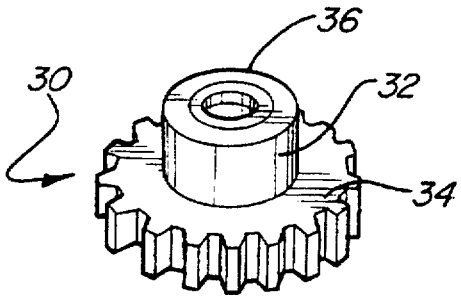
FIG. 8 is an elevational view showing a finished component constructed according to the method depicted in FIGS. 5–7 of the drawing.

With reference now to FIG. 5, a modification of the present invention is thereshown for producing a gear 30 shown in FIG. 8. The gear 30, like the gear 19 shown in FIG. 4, includes both a hub 32 and a radially outwardly extending flange or gear ring 34. Unlike the gear 19 of FIG. 4, only an other ring 36 at the end of the hub 32 is formed of a low carbon, and thus weldable, steel or iron. Conversely, the inner periphery of the gear hub 32 throughout its entire length is formed of a high strength, high carbon steel.

With reference now to FIG. 5, in order to form the gear 30 of FIG. 8, an annular separator 40 is first positioned within the lower die half 12 thus separating the lower cylindrical portion 20 of the die cavity 18 corresponding to the hub 19 into an inner ring 42 and an outer ring 44. The low carbon powdered steel or iron 24 is then filled into the outer ring 44 of the die cavity 18. The separator 40, however, prevents the low carbon powdered metal 24 from entering into the inner ring 42 of the die cavity 18.

Figure 6:
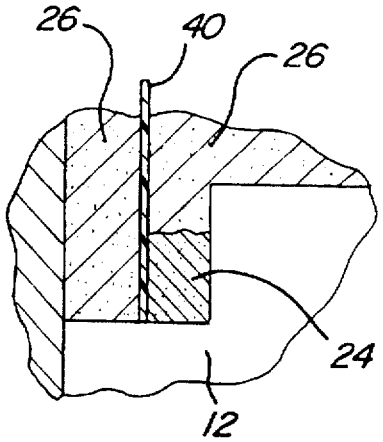
FIG. 6 is a fragmentary view similar to FIG. 3 but illustrating a modification thereof.
Figure 7:
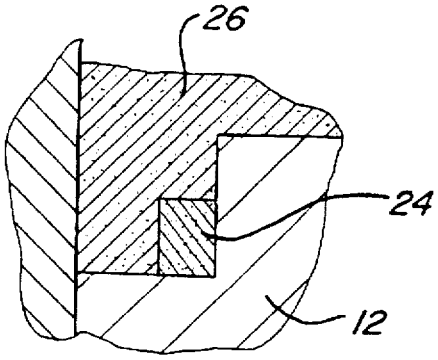
FIG. 7 is a fragmentary view similar to FIG. 6 and illustrating a further step of the method of the present invention.

With reference now to FIG. 6, the remainder of the mold cavity is then filled with the high carbon powdered metal 26 and then, as shown in FIG. 7, the separator 40 is removed. Since the mold cavity is filled with powdered metal, however, the low carbon powdered metal remains substantially in the outer circumferential area at the outer axial end of the hub 20. The powdered metal in the die cavity 22 is then compacted and sintered in the previously described fashion to complete the component.

From the foregoing, it can be seen that the method of the present invention provides a unique method of forming a composite powdered metal part having distinct regions of weldable and non-weldable metals. Furthermore, even though the present invention has been described for manufacturing a gear having only two distinct regions of non-weldable and weldable metals, it will be understood that the part may include three or even more distinct regions of weldable and non-weldable metals without deviating from either the spirit or the scope of the present invention.

The present invention can also he practiced to construct components having zones of differential hardness by using two or more powders having different carbon content.

Figure 9:
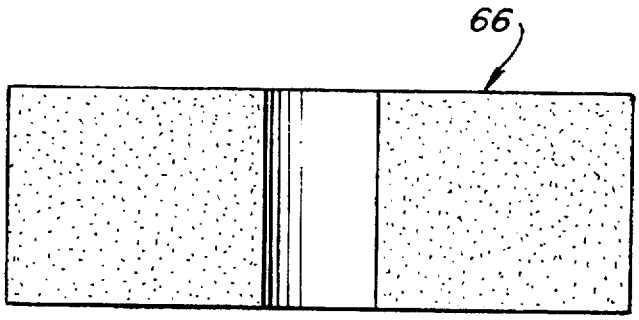
FIG. 9 is a crossectional view illustrating a first step in an alternate embodiment of the invention.
Figure 10:
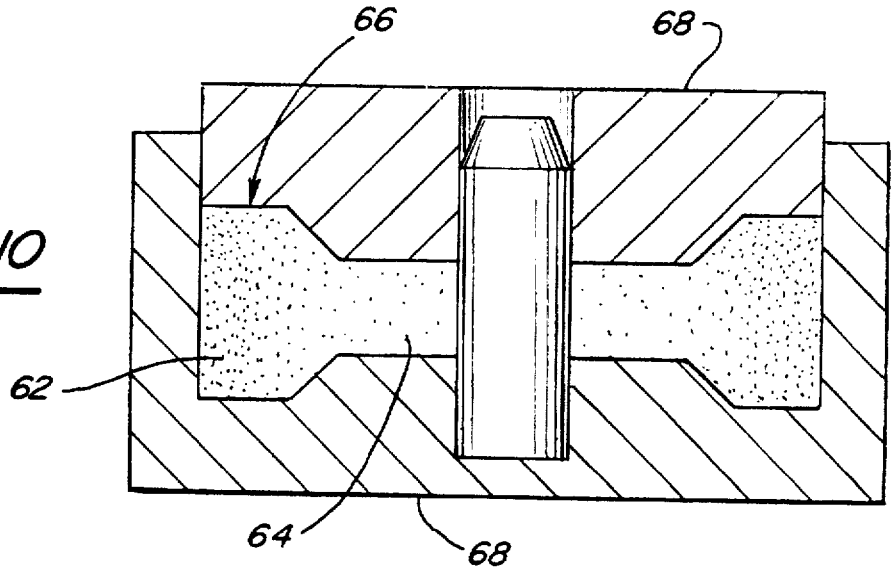
FIG. 10 is a crossectional view illustrating a further step in the alternate embodiment of the invention.
Figure 11:
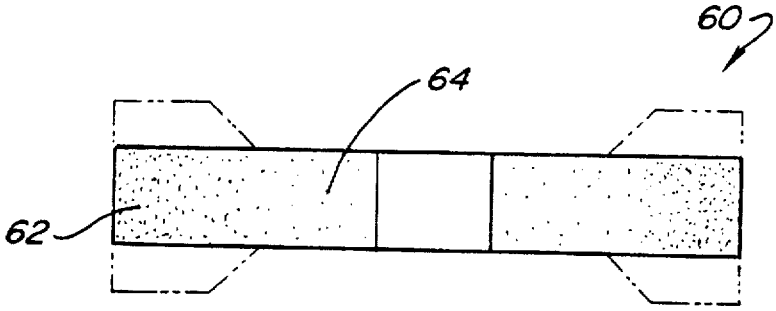
FIG. 11 is a crossectional view illustrating another step of the alternate embodiment of the invention.

With reference now to FIGS. 9–11, an alternate embodiment of the present invention is shown in which the final part 60 (FIG. 11) has a first region 62 of relatively high porosity and thus low density, and a second region 64 of low porosity and thus high density. The material in each region 62 and 64 may be the same. In some situations, the high porosity region 62 is desirable to accept coatings for vacuum impregnation, and/or other treatments while the higher density region 64 enjoys higher hardness and toughness as compared to the low density region 62.

In order to construct the final part 60 (FIG. 11), a preform 665 (FIG. 9) is first formed by pressing the powdered metal together in the approximate shape of the final part. At this time, the preform 66 is of substantially uniform density.

As best shown in FIG. 10, the preform 66 is forged by dies 68. Furthermore, the dies 68 are shaped such that the inner region 64 undergoes higher compression than the outer region 62 so that the higher compression creates higher density and less porosity than the outer region 62.

The forged preform (FIG. 10) is then sintered and machined to form the final component 60 (FIG. 11). It will be understood, of course, that the part 60 illustrated in FIG. 11 is simple in construction and intended merely for purposes of illustrations. In actual practice, parts of more complex design and having two, three or even more regions of different densities can be constructed using the present invention.

Having described my invention, however, many modifications thereto will become apparent to those skilled in the art to which it pertains without deviation from the spirit of the invention as defined by the scope of the appended claims.

I claim:

1. A method for constructing a composite powdered metal component with a die having at least two die parts which together define a die cavity therebetween comprising the steps of:

inserting a separator into the die cavity, said separator dividing said die cavity into a first portion and a second portion, filling said first portion of the die cavity with a first weldable powdered metal, said die cavity having a shape corresponding to the shape of the component, filling said second portion of the die cavity with a second non-weldable powdered metal, removing said separator from the die casting, compacting said first and second powders in said die cavity to form a compacted component, and sintering said compacted component, wherein said first weldable powdered metal comprises powdered steel having a carbon content of less than 0.6% by weight and wherein said second non-weldable second powdered metal comprises powdered steel having a carbon content of more than 0.6% by weight.

2. The invention as defined in claim 1 wherein said powdered metals each comprise powdered steel and wherein said first powdered metal has a carbon content of less than 0.6% by weight while said second powdered metal has a carbon content of more than 0.67% by weight.

3. The invention as defined in claim 1 wherein said die cavity is annular in shape having an axis and wherein said second portion of said die cavity comprises one axial end of said die cavity.

4. The invention as defined in claim 1 wherein said heating step comprises hot pressing said powders.

5. The invention as defined in claim 1 wherein said sintering step is carried out at a temperature just less than the liquids temperature of said powders.

6. A method for constructing a powdered metal component having two or more regions of different density in a due cavity comprising the steps of:

inserting a separator into the die cavity, said separator dividing said cavity into a first portion and a second portion, filling the first portion of the die cavity with a first powdered metal having a carbon content greater than 0.6% by weight, said die cavity having a shape corresponding to the shape of the component, filling the second portion of the die cavity with a second powdered metal having a carbon content less than 0.6% by weight, removing said separator from the die cavity, compacting said first and second powders in said die cavity to form a compacted component, and sintering said compacted component, wherein the portion of the component formed by said second powder is weldable.

7. The invention as defined in claim 6 wherein said powdered metals each comprise powdered steel.

8. The invention as defined in claim 6 wherein said die cavity is annular in shape having an axis and wherein said second portion of said die cavity comprises one axial end of said mold cavity.

9. The invention as defined in claim 6 wherein said sintering step is carried out at a temperature just less than the liquids temperature of said powders.

10. A composite metal component formed by the process of:

filling a first portion of a die cavity with a first weldable powdered metal, said die cavity having a shape corresponding to the shape of the component, filling a second portion of the die cavity with a second non-weldable powdered metal, compacting said first and second powders in said die cavity to form a compact, and sintering the compact, wherein said first weldable powdered metal comprises powdered steel having a carbon content of less than 0.6% by weight and wherein said second non-weldable second powdered metal comprises powdered steel having a carbon content of more than 0.6% by weight.

11. A method for constructing a composite powdered metal component with a die having two die part which together define a die cavity therebetween comprising the steps of:

inserting a separator into the die cavity, said separator dividing said die cavity into a first portion and a second portion, filling the first portion of the die cavity with a first powdered metal, said die cavity having a shape corresponding to the shape of the component, filling the second portion of the die cavity with a second powdered metal, removing the separator from the die cavity, compacting said first and second powders in said die cavity to form a compacted component, and sintering said compacted component, wherein said first and second powders have different carbon content so that said powders form zones of differential hardness of the component, and wherein said first weldable powdered metal comprises powdered steel having a carbon content of less than 0.6% by weight and wherein said second non-weldable second powdered metal comprises powdered steel having a carbon content of more than 0.6% by weight.

12. A method for constructing a composite powdered metal component with a die having two die parts which together define a die cavity therebetween comprising the steps of:

inserting a separator into the die cavity, said separator dividing said die cavity into a first portion and a second portion, filling the first portion of the die cavity with a first powdered metal, said die cavity having a shape corresponding to the shape of the component, filling the second portion of the die cavity with a second powdered metal, removing the separator from the die cavity, compacting said first and second powders in said die cavity to form a compacted component, and sintering said compacted component, wherein said first weldable powdered metal comprises powdered steel having a carbon content of less than 0.6% by weight and wherein said second non-weldable second powdered metal comprises powdered steel having a carbon content of more than 0.6% by weight.

* * * * *

UNITED STATES PATENT AND TRADEMARK OFFICE

CERTIFICATE OF CORRECTION

PATENT NO. : 5,903,815
DATED : May 11, 1999
INVENTOR(S) : Norman William Scott

It is certified that error appears in the above-identified patent and that said Letters Patent is hereby corrected as shown below:

Title page,

Abstract, line 3 - Replace "discreet" with --discrete--.
Abstract, line 16 - Replace "alloyed" with --alloys--.
Column 1, line 40 - Replace "he" with --be--.
Column 1, line 49 - Insert --.-- after the word "weldable".
Column 2, line 35 - Replace "discreet" with --discrete--.
Column 2, line 57 - Replace "drawing" with --drawings--.
Column 2, line 60 - Replace "crossectional" with --cross sectional--.
Column 3, line 14 - Replace "crossectional" with --cross sectional--.
Column 4, line 37 - Replace "19" with --32--.
Column 4, line 49 - Replace "20" with --24--.
Column 4, line 50 - Replace "22" with --18--.
Column 5, line 10 - Replace "665" with --66--.

Column 5, line 58 - Replace "0.67%" with --0.6%--.
Column 6, line 29 - Replace "liquids" with --liquidus--.
Column 6, line 37 - Replace "powders" with --powdered metals--.
Column 6, line 46 - Replace "part" with --parts--.

Signed and Sealed this

Third Day of October, 2000

*Attest:*

Q. TODD DICKINSON

*Attesting Officer*

*Director of Patents and Trademarks*